United States Patent [19]

Falk

[11] 4,167,440

[45] Sep. 11, 1979

[54] SPRAY CLEANING APPARATUS

[75] Inventor: Carl H. Falk, Karlstad, Sweden

[73] Assignee: Aktiebolaget Karlstads Mekaniska Werkstad, Karlstadt, Sweden

[21] Appl. No.: 842,259

[22] Filed: Oct. 14, 1977

[30] Foreign Application Priority Data

Oct. 18, 1976 [SE] Sweden ..... 7611528

[51] Int. Cl.[2] ..... D21F 1/32; D21F 1/34

[52] U.S. Cl. ..... 162/277; 239/186

[58] Field of Search ..... 162/277, 278, 275; 134/122 R, 129, 172; 239/567, 587, 264, 186

[56] References Cited

U.S. PATENT DOCUMENTS

| | | | |
|---|---|---|---|
| 941,750 | 11/1909 | Wyant | 162/277 |
| 1,594,306 | 7/1926 | Lenz et al. | 162/277 |
| 1,606,172 | 11/1926 | Morns et al. | 162/277 |

FOREIGN PATENT DOCUMENTS

| | | |
|---|---|---|
| 1105704 | 4/1961 | Fed. Rep. of Germany . |
| 1196955 | 7/1965 | Fed. Rep. of Germany . |
| 150131 | 5/1955 | Sweden . |

OTHER PUBLICATIONS

Broughton Bulletin AB-1A by Albany Engineering Systems; Glen Falls, New York, Mar. 1973.

*Primary Examiner*—Richard V. Fisher

*Attorney, Agent, or Firm*—Bell, Seltzer, Park & Gibson

[57] ABSTRACT

A spray cleaning apparatus for foraminous elements of papermaking machines and the like such as wires and felts and the like in which an elongate spray manifold for spraying liquid is mounted in an elongate carrier which is supported for movement longitudinally and relative to a machine element to be cleaned. A drive is provided for reciprocating the carrier longitudinally, and the spray manifold is arranged to be easily detachable from the carrier so as to move with the carrier while being removable therefrom as necessitated by maintenance service and the like.

9 Claims, 5 Drawing Figures

PRESSURE SOURCE
CONTROL MEANS

SPRAY CLEANING APPARATUS

This invention relates to a spray cleaning apparatus for foraminous elements of papermaking machines and the like such as wires and felts and the like.

In papermaking machines and the like, in which wires, felts, suction rolls and the like are used separately or in combination for forming, de-watering, or transporting fibrous webs, it is necessary to clean such foraminous elements in order to maintain proper functioning of such elements. In most instances, such cleaning is accomplished by spraying liquid such as water to wash off fibers, fiber fragments and other trash or impurities which may cling to the wires, felts or suction rolls. Heretofore, in efforts to reduce the quantity of spraying water required, a so-called reciprocating or oscillating spray or shower has been used, in which an elongate spray manifold is caused to move in its longitudinal direction with a reciprocating movement, across or transversely of the running direction of a wire or felt to be cleaned or generally parallel to the axis of a suction roll to be cleaned. Such spray cleaning apparatus are shown for example by German Auslegeschriften Nos. 1,105,704 and 1,196,955.

The liquid circulated through a spray cleaning apparatus is fresh water or, as proposed heretofore, so-called "white water" which is derived from the papermaking process and which has been subjected to a purification process before being used for cleaning. While white water has been somewhat purified, it frequently happens that nozzles provided in the spray cleaning apparatus become clogged and must be cleaned by an operator. While proposals have been made for continually cleaning shower pipes (as in Swedish Pat. No. 150,131) such devices have not been successful and cleaning has continued to be done manually. In the instance of papermaking machines, such manual cleaning requires either the provision of a catwalk adjacent the spray apparatus or the removal of the spray manifold or shower pipe from the machine. Particularly with previously known reciprocating or oscillating apparatus, such removal or demounting is complicated as the drive arrangement for the spray manifold must also be removed. Also, the machine has to be stopped, which means a discontinuance of the production. Further, the size of such spray cleaning apparatus gives rise to substantial risk of damaging wires, felts, the spray apparatus or other portions of the papermaking machine during cleaning of the spray apparatus. As can be appreciated, damage to such components of a machine can present substantial risk.

In light of the difficulties encountered with prior known spray cleaning apparatus of the type to which the present invention relates, it is an object of the present invention to eliminate or substantially decrease the risk for damage to elements of a papermaking machine or spray cleaning apparatus. In realizing the object of the present invention, a spray cleaning apparatus is contemplated from which the spray manifold which must be cleaned may be readily removed without requiring a catwalk or gangway extending across the machine.

Yet a further object of the present invention is to facilitate maintaining desired cleaning performance for a spray cleaning apparatus having a removable spray manifold. In realizing this object of the present invention, arrangements are provided for positively positioning the spray manifold in non-rotatable engagement with a carrier, while restraining the carrier to movement in predetermined paths.

Some of the objects of the invention having been stated, other objects will appear as the description proceeds, when taken in connection with the accompanying drawings, in which FIG. 1 is a perspective view, partly broken away, of a spray cleaning apparatus in accordance with the present invention;

While the present invention will be described in greater detail hereinafter with reference to the accompanying drawings, it is to be understood at the outset of the following description that it is contemplated that persons skilled in the applicable arts may depart from the specific forms of the invention shown and to be described. Accordingly, the description which follows and the drawings to which the description refers are to be understood as a broad teaching of the present invention directed to persons skilled in the applicable arts, and not as being restrictive upon the scope of the present invention.

Figures 1, 2, 3:
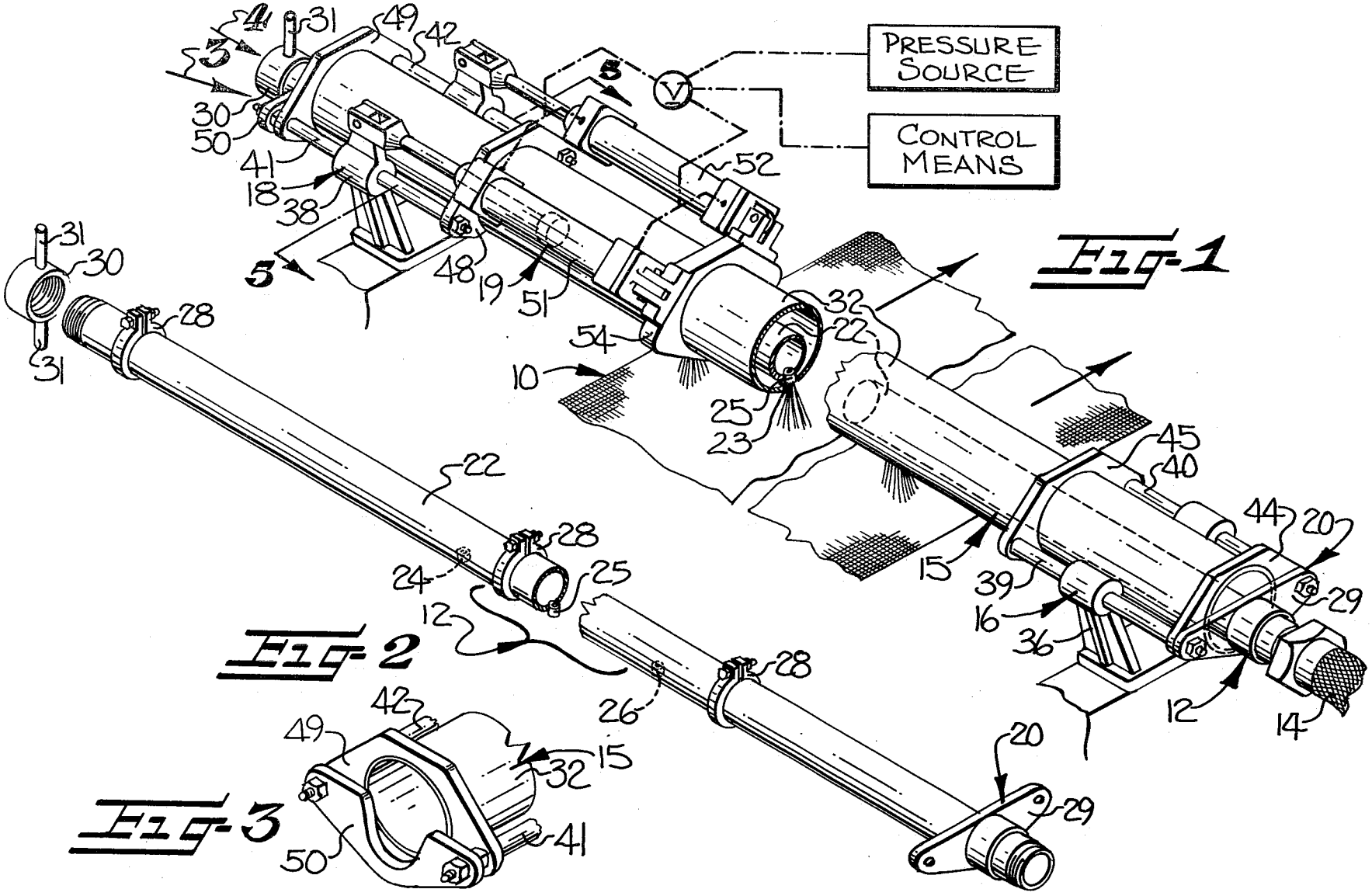
FIG. 2 is a view similar to FIG. 1, illustrating an elongate spray manifold portion of the apparatus of FIG. 1.
FIG. 3 is an enlarged perspective view of a portion of the apparatus of FIG. 1, taken generally as indicated by the arrow 3 in FIG. 1.
Figure 4:
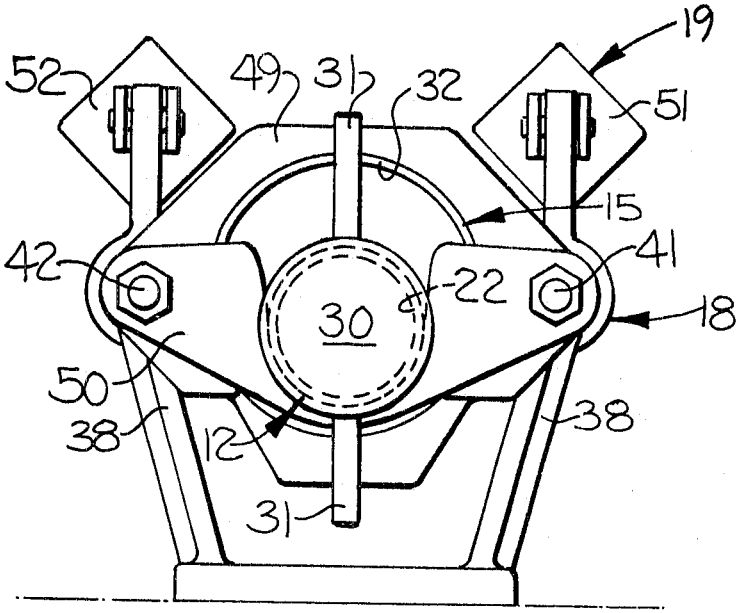
FIG. 4 is an elevation view taken generally as indicated by the arrow 4 in FIG. 1.

Referring now more particularly to FIG. 1, the spray cleaning apparatus of the present invention is thereshown as applied for cleaning a foraminous element such as a wire generally indicated at 10 for a papermaking machine and the like (not shown in full). Persons skilled in the applicable arts will recognize the utility of the present invention, as described hereinafter, with reference to other such foraminous elements. The apparatus of the present invention has an elongate spray manifold means generally indicated at 12 for spraying liquid supplied through a flexible hose 14 or other suitable conduit. An elongate carrier means, generally indicated at 15, is provided for mounting the manifold means 12. The carrier means 15 is supported by suitable means, preferably in the form of two means respectively generally indicated at 16 and 18 mounted on portions of the papermaking machine or other apparatus at locations spaced transversely of the wire 10 or other element to be cleaned. Drive means generally indicated at 19 are operatively connected with the carrier means 15 for reciprocating the carrier means longitudinally. Finally, easily detachable securing means generally indicated at 20 and 21 are provided for securing the manifold means 12 in mounting engagement with the carrier means 15 for reciprocation therewith.

In the form illustrated, the manifold means 12 takes the form of an elongate pipe 22 having a length sufficient to more than span the element to be cleaned, such as the wire 10. The pipe 22 has a plurality of nozzles, three of which are indicated at 24, 25, 26, spaced therealong through which liquid delivered into the pipe 22 is sprayed. The pipe has a plurality of mounting collars 28 fixed thereabout for purposes which will become more clear hereinafter and a yoke means 29 fixed thereto adjacent the end through which liquid is delivered. The end of the pipe 22 remote from the yoke 29 is closed by a suitable threaded cap 30 having radially extending handles 31 to facilitate manual attachment and removal of the cap 30.

Figure 5:
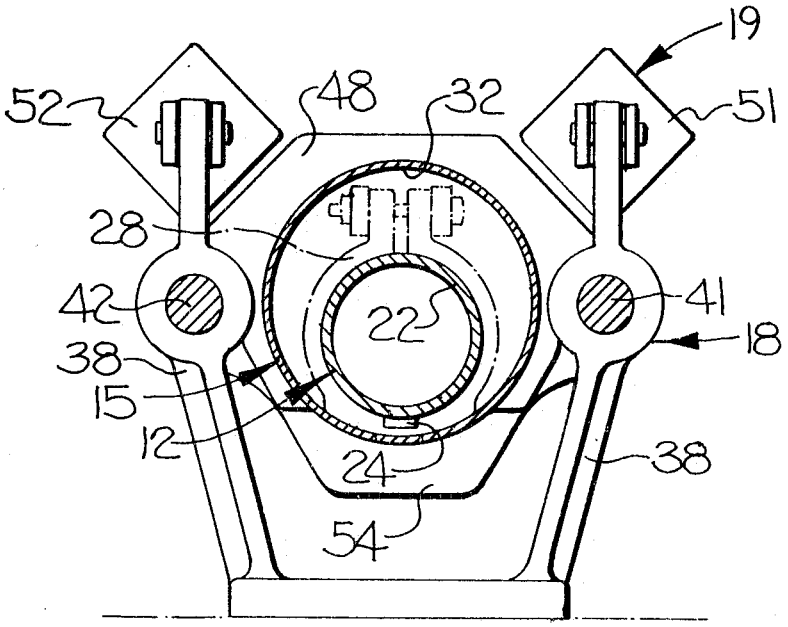
FIG. 5 is an elevation view, in section, taken generally along the line 5—5 in FIG. 1.

The carrier means 15 comprises a tubular member for telescopically receiving the manifold means 12. In the form shown, the carrier means is a pipe 32 having a diameter substantially larger than the diameter of the manifold pipe 22. In point of fact, the diameter of the pipe 32 is sufficiently large as to encircle the mounting collars 28 (FIG. 5). The collars 28 provide a spacing of the manifold pipe 22 within the carrier pipe 32 which avoids damage of the nozzles 24, 25, 26 and the like upon telescopic removal and insertion of the manifold pipe 22 in the carrier pipe 32.

The supporting means 16, 18 for the carrier means 15 comprise a pair of spaced, bifurcated bracket members 36, 38 for supporting respective end portions of the carrier means 15. Each of the brackets 36, 38 has on each bifurcation thereof a bushing means for slidably receiving a corresponding guide rod 39, 40, 41, 42. Each of the brackets 36, 38 receives the carrier means 15 between the bifurcations thereof and the plurality of guide rods 39, 40, 41, 42 cooperate for forming a bearing means which restrains the carrier means 15 to linear reciprocation. As will be understood, the guide rods, 39, 40, 41, 42 are mounted on the carrier means 15 parallel one to another and to a longitudinal axis of the carrier means, while being slidably received in the bushings provided by the bracket members 36, 38. The rods 39, 40, 41, 42 are fixed to the carrier means 15 by means of spaced plate members 44, 45, 48, 49.

The rods and two plate members 44, 49 cooperate with the yoke 29 fixed to the spray manifold pipe 22 and with a detachable yoke 50 (FIG. 3) in defining a securing means which secures the manifold means 12 and the carrier means 15 against rotation one relative to the other about the longitudinal axes thereof. More particularly, fastener means formed at the ends of the rods penetrate the yokes upon telescopic insertion of the manifold means 12 into the carrier means 15, for securing those elements together.

In order to reciprocate the carrier means 15 longitudinally of its own longitudinal axis, and thereby move the sprays delivered through the spray manifold means 12, drive means 19 are provided, preferably in the form of a pair of expansible chamber, fluid pressure actuated devices 51, 52. The devices 51, 52 are arranged to act between one bracket 38 and a mounting plate 54 fixed to the carrier means 15, in such a way that reciprocation of the piston rods of the devices 51, 52 relative to the cylinders thereof moves the carrier means 15 and thus the spray manifold means 12 in linear reciprocation.

As will be appreciated, means defining at least one aperture 23 (FIG. 1) must be provided through the carrier means 15 in order to accommodate the delivery of sprays through the nozzles 24, 25, 26 and the like. Preferably, such apertures take the form of a plurality of holes formed in the carrier means 15 and each aligned with a nozzle. Alternatively, a longitudinal slot (not shown) may be substituted for the apertures but such a slot reduces the rigidity of the carrier means 15 and is therefore a less preferred arrangement.

In order to clean the spray manifold pipe 22, the drive means and the supply of white water are shut off and the screw cap 30 is removed. By loosening the yokes, it is then possible to pull the spray manifold pipe 22 out of the carrier pipe 32 to clean the nozzles. The cleaned spray pipe 22 may then be returned as desired.

It is believed that persons skilled in the applicable arts will recognize variations which can be made on the structure and arrangement described to this point. By way of example only, the drive means need not be fluid pressure actuated, but may be electro-mechanical or the like. Further, the carrier means 15 and spray manifold means 12 may, if desired, be made rotatable one relative to the other for flushing the interior of the mounting pipe 32. The spray manifold means and the tubular carrier means may both be of a generally polygonal, such as a regular triangular cross section. Then, the tubular carrier means may have an internal stiffening member and a longitudinal slot for the nozzles located at an opposite corner of the cross section, and the bearing means may comprise rollers mounted for rolling engagement with at least some of the exterior surfaces of the polygonal carrier means. In addition, the spray manifold means may have only one end projecting out of the carrier means and may be secured by means of a transversally swingable latch carried by the carrier means and cooperating with two axially spaced stud members or the like provided on the projecting end of the spray manifold means. Further, the spraying apparatus can be equipped with any desired safety system which might interrupt spray cleaning and operate an alarm in the event of clogging or should the frequency of reciprocation of the apparatus become too low.

In the drawings and specification, there has been set forth a preferred embodiment of the invention, and although specific terms are employed, they are used in a generic and descriptive sense only and not for purposes of limitation.

That which is claimed is:

1. Spray cleaning apparatus for foraminous elements of papermaking machines and the like such as wires and felts and the like, the apparatus comprising elongate spray manifold means having a plurality of nozzles for spraying liquid directly from the nozzles onto a foraminous element to be cleaned, elongate carrier means for mounting said manifold means in a position generally transverse to a path of travel of said foraminous element and having means defining at least one aperture aligned with said nozzles for accommodating delivery of sprayed liquid directly onto the foraminous element, means for supporting said carrier means for movement longitudinally and relative to said support means, drive means operatively connected with said carrier means for reciprocating said carrier means longitudinally, and easily detachable securing means for securing said manifold means in mounting engagement with said carrier means for reciprocation therewith.

2. Apparatus according to claim 1 wherein said carrier means comprises a tubular member for telescopically receiving said manifold means.

3. Apparatus according to claim 1 wherein said supporting means comprises bearing means for restraining said carrier means to linear reciprocation.

4. Apparatus according to claim 1 wherein said securing means secures said manifold means and said carrier means against rotation one relative to the other about the longitudinal axes thereof.

5. Spray cleaning apparatus for foraminous elements of papermaking machines and the like such as wires and felts and the like, the apparatus comprising an elongate spray manifold means having a plurality of nozzles for spraying liquid from the nozzles onto a foraminous element to be cleaned, elongate carrier means for mounting said manifold means in a position generally transverse to a path of travel of said foraminous element, a pair of spaced bifurcated bracket members for supporting respective end portions of said carrier means, each said bracket having on each bifurcation thereof bushing means for slidably receiving a guide rod, each said bracket receiving said carrier means between the bifurcations thereof, a plurality of guide rods mounted on said carrier means parallel one to another and to a longitudinal axis of said carrier means, said guide rods being slidably received in said bushings, drive means operatively connected with said carrier means for reciprocating said carrier means longitudinally, and easily detachable securing means for securing said manifold means in mounting engagement with said carrier means for reciprocation therewith.

6. Spray cleaning apparatus for foraminous elements of papermaking machines and the like such as wires and felts and the like, the apparatus comprising elongate spray manifold means having a plurality of nozzles for spraying liquid from the nozzles onto a foraminous element to be cleaned, elongate carrier means for mounting said manifold means in a position generally transverse to a path of travel of said foraminous element, means for supporting said carrier means for movement longitudinally and relative to said support means, drive means operatively connected with said carrier means for reciprocating said carrier means longitudinally, yoke means attached to said manifold means adjacent one end thereof, and fastener means attached to said carrier means adjacent one end thereof, said yoke means and said fastener means engaging one another upon mounting engagement of said manifold means with said carrier means and cooperating for securing said manifold means in mounting engagement with said carrier means for reciprocation therewith while accommodating easy detachment of said manifold means from said carrier means.

7. Spray cleaning apparatus for foraminous elements of papermaking machines and the like such as wires and felts and the like, the apparatus comprising: elongate, tubular spray manifold means having a plurality of nozzles for spraying liquid directly from the nozzles onto a foraminous element to be cleaned; elongate, generally tubular carrier means for telescopically receiving said manifold means and for at least partially enclosing said manifold means and for mounting said manifold means in a position generally transverse to a path of travel of said foraminous element, said carrier means having means defining at least one aperture aligned with said nozzles for accommodating delivery of sprayed liquid directly onto the foraminous element; bearing means for supporting said carrier means for movement longitudinally of the longitudinal axis thereof and for restraining said carrier means against rotation about the longitudinal axis; drive means operatively connected with said carrier means for reciprocating said carrier means longitudinally; and easily detachable securing means for securing said manifold means in mounting engagement at least partially within said carrier means for reciprocation therewith and for securing said manifold means and said carrier means against rotation one relative to the other about the longitudinal axis.

8. Apparatus according to claim 7 wherein said drive means comprises at least one expansible chamber, fluid pressure actuated device.

9. Spray cleaning apparatus for foraminous elements of papermaking machines and the like such as wires and felts and the like, the apparatus comprising elongate, tubular spray manifold means having a plurality of nozzles for spraying liquid from the nozzles onto a foraminous element to be cleaned; elongate, generally tubular carrier means for telescopically receiving said manifold means and for at least partially enclosing said manifold means and for mounting said manifold means in a position generally transverse to a path of travel of said foraminous element; said manifold means having a length greater than that of said carrier means; bearing means for supporting said carrier means for movement longitudinally of the longitudinal axis thereof and for restraining said carrier means against rotation about the longitudinal axis; drive means operatively connected with said carrier means for reciprocating said carrier means longitudinally; yoke means attached to spaced terminal end portions of said manifold means for mounting engagement with opposite end portions of said carrier means and cooperating for securing said manifold means in mounting engagement at least partially within said carrier means for reciprocation therewith and for securing said manifold means and said carrier means against rotation one relative to the other about the longitudinal axis while accommodating easy detachment of said manifold means from said carrier means.

* * * * *